US008261885B2

(12) United States Patent
Ketoviita et al.

(10) Patent No.: US 8,261,885 B2
(45) Date of Patent: Sep. 11, 2012

(54) SAFETY ARRANGEMENTS FOR ELEVATORS AND METHODS FOR MONITORING SAFETY OF ELEVATOR SYSTEMS

(75) Inventors: Seppo Ketoviita, Hyvinkää (FI); Juha Panula, Hämeenlinna (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 13/317,252

(22) Filed: Oct. 13, 2011

(65) Prior Publication Data

US 2012/0031707 A1 Feb. 9, 2012

Related U.S. Application Data

(63) Continuation of application No. PCT/FI2010/000024, filed on Apr. 8, 2010.

(30) Foreign Application Priority Data

Apr. 23, 2009 (FI) ..... 20090163

(51) Int. Cl.
*B66B 1/34* (2006.01)

(52) U.S. Cl. ..... 187/391; 187/314

(58) Field of Classification Search ..... 187/247, 187/313, 314, 343, 344, 351, 357, 391–394
See application file for complete search history.

(56) References Cited

U.S. PATENT DOCUMENTS

| | | | | |
|---|---|---|---|---|
| 5,644,111 | A * | 7/1997 | Cerny et al. | 187/393 |
| 6,050,369 | A * | 4/2000 | Leone et al. | 187/392 |
| 6,138,798 | A * | 10/2000 | Macuga | 187/294 |
| 6,202,797 | B1 * | 3/2001 | Skolnick et al. | 187/317 |
| 6,223,861 | B1 * | 5/2001 | Sansevero | 187/316 |
| 6,550,585 | B2 * | 4/2003 | Schoppa et al. | 187/391 |
| 6,603,398 | B2 * | 8/2003 | Tinone et al. | 340/541 |
| 6,630,886 | B2 * | 10/2003 | Malone, Jr. | 340/540 |
| 6,736,242 | B2 * | 5/2004 | Nygren | 187/357 |
| 7,077,243 | B2 * | 7/2006 | Huber et al. | 187/357 |
| 7,201,256 | B2 * | 4/2007 | Deplazes et al. | 187/300 |
| 7,249,656 | B2 * | 7/2007 | Huber et al. | 187/343 |
| 7,278,517 | B2 * | 10/2007 | Gut | 187/300 |
| 7,350,627 | B2 * | 4/2008 | Ketonen et al. | 187/400 |
| 7,650,969 | B2 * | 1/2010 | Monzon et al. | 187/300 |

(Continued)

FOREIGN PATENT DOCUMENTS

JP 03018575 A 1/1991

(Continued)

OTHER PUBLICATIONS

International Search Report for International Application No. PCT/FI2010/000024 filed Apr. 8, 2010.

*Primary Examiner* — Anthony Salata
(74) *Attorney, Agent, or Firm* — Harness, Dickey & Pierce, PLC

(57) ABSTRACT

A safety arrangement of an elevator includes a mechanical safety device (3, 4, 11) that ensures the safety of the elevator hoistway (2) and that can be moved into a use position (2), and which safety arrangement of an elevator includes a detector (5) of intrusion into the elevator hoistway, which detector is fitted to receive measuring data (6) from the sensors (7) that determine the status of the entrances (9, 10) of the elevator hoistway, and also to determine intrusion into the elevator hoistway (2) from the measuring data received, and after verifying an intrusion to switch into an operating mode (8) in which driving with the elevator is prevented.

18 Claims, 4 Drawing Sheets

U.S. PATENT DOCUMENTS

Figure 1:
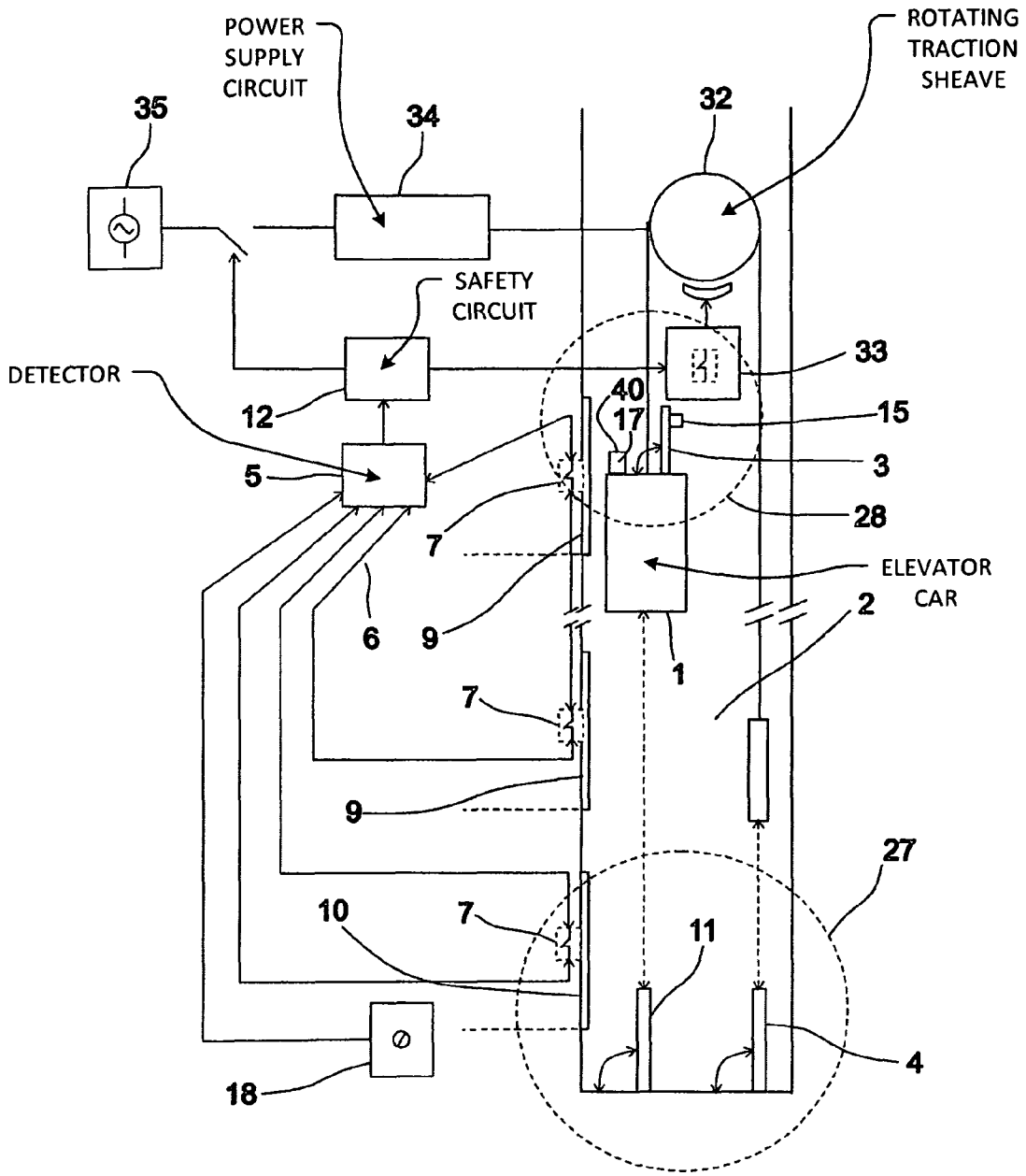

| | | | | |
|---|---|---|---|---|
| 7,832,526 | B2 * | 11/2010 | Sirigu | 187/357 |
| 7,954,606 | B2 * | 6/2011 | Tinone et al. | 187/384 |
| 8,028,808 | B2 * | 10/2011 | Gonzalez Rodil et al. | 187/391 |
| 8,069,956 | B2 * | 12/2011 | Okada | 187/287 |
| 2002/0084148 | A1 | 7/2002 | Nygren | |
| 2002/0117358 | A1 | 8/2002 | Schoppa et al. | |
| 2007/0240942 | A1 | 10/2007 | Sirigu | |
| 2009/0255762 | A1 | 10/2009 | Ketonen et al. | |
| 2009/0321192 | A1 | 12/2009 | Kattainen et al. | |
| 2010/0155182 | A1 * | 6/2010 | Ueda et al. | 187/280 |
| 2011/0083926 | A1 * | 4/2011 | Rasanes et al. | 187/300 |
| 2012/0006628 | A1 * | 1/2012 | Ueda et al. | 187/277 |
| 2012/0006631 | A1 * | 1/2012 | Ueda et al. | 187/393 |

FOREIGN PATENT DOCUMENTS

| | | | |
|---|---|---|---|
| WO | WO-9723399 | A2 | 7/1997 |
| WO | WO-2005105644 | A1 | 11/2005 |
| WO | WO-2008081073 | A1 | 7/2008 |

* cited by examiner

SAFETY ARRANGEMENTS FOR ELEVATORS AND METHODS FOR MONITORING SAFETY OF ELEVATOR SYSTEMS

This Application is a Continuation of International Application PCT/FI2010/000024, filed Apr. 8, 2010, and claims priority under 35 U.S.C. §119 to Finnish Application No. 20090163, filed Apr. 23, 2009, the entire contents of which are hereby incorporated by reference.

The present invention relates to safety arrangements of elevators and methods for monitoring safety in elevator systems.

When modernizing the elevators of old buildings, problems are often encountered because the safety regulations have changed over the years, and the headrooms and bottom clearances in the elevator hoistway above and below the car in the elevator hoistway are not large enough to meet the requirements of modern safety regulations. Extending the hoistway upwards or downwards is in most cases impossible in terms of construction engineering or at least so expensive and difficult that it is not viable.

One goal in new buildings is to save space in the elevator hoistway. This is done by dimensioning the headrooms and bottom clearances in the elevator hoistway to be as small as possible. In this case there is no longer adequate safety clearance for personnel protection above and below the elevator car for a serviceman working on the roof of the elevator car or in the elevator hoistway.

The performance of servicing work in the elevator hoistway has become more general owing in particular to so-called elevators without machine room, because in these elevators the hoisting machine and often also the control of the hoisting machine is disposed in the elevator hoistway and not in the machine room as is conventional.

Often a turnable buffer disposed on the bottom of the hoistway is used as a safety device in the service spaces of an elevator hoistway, which the serviceman turns into a vertical use position before working in the elevator hoistway.

The level of earlier prior art is presented in the publication WO 97/23399. This publication discloses an apparatus to be arranged for the bottom safety clearance of an elevator, in which a support column is arranged on the path of travel of the car sling, which is turned into the operating state with an actuating element, which is supported on the floor of the hoistway and on the support column. The necessary switches, which indicate the position of the support column, are arranged in connection with the support column.

Publication JP03018575 presents a switch installed in connection with a mechanical safety device, the position of which switch changes at the same time as the mechanical safety device is turned into the operating state. Driving with the elevator motor is only permitted when the switching of the mechanical safety device to the operating state can be read from the change of state of the switch.

The aim of the invention is to disclose a safety arrangement for implementing a safe area in an elevator hoistway using information about the status of the entrances of the elevator hoistway. By means of the safety arrangement according to the invention the performance of servicing jobs in the elevator hoistway will be more trouble-free than nowadays.

The safety arrangement of an elevator according to the invention is characterized in that, for example, a detector of intrusion into the elevator hoistway is fitted to determine on the basis of the measuring data received the area of intrusion from where intrusion into the elevator hoistway has occurred, and in that the detector of intrusion into the elevator hoistwav is fitted to delimit a safe area of the elevator hoistway corresponding to the determined area of intrusion, and in that the safety arrangement of the elevator is fitted to permit service drive after the mechanical safety device that is disposed in the safe area delimited by the detector of intrusion into the elevator hoistway, and that ensures the safety of the elevator hoistway is moved into the use position. The method according to the invention for monitoring the safety of an elevator is characterized by: determining an area of intrusion, from where intrusion into the elevator hoistway has occurred, from the measured status of the entrances of the elevator hoistway; delimiting the safe area of the elevator hoistway corresponding to the determined area of intrusion; and permitting service drive after the mechanical safety device that is disposed in the delimited safe area and that ensures the safety of the elevator hoistway is moved into the use position. Other features of the invention are characterized by what is disclosed in the other claims.

Some inventive embodiments are also discussed in the descriptive section of the present application. The inventive content of the application can also be defined differently than in the claims presented below. The inventive content may also consist of several separate inventions, especially if the invention is considered in the light of expressions or implicit subtasks or from the point of view of advantages or categories of advantages achieved. In this case, some of the attributes contained in the claims below may be superfluous from the point of view of separate inventive concepts.

According to the invention an area from where an intrusion into the elevator hoistway has occurred is determined by means of a detector of intrusion into the elevator hoistway, and a safe area of the elevator hoistway corresponding to the determined area of intrusion is delimited. The safety arrangement of the elevator permits service drive after the mechanical safety device that is disposed in the safe area of the elevator hoistway delimited by the detector of intrusion into the elevator hoistway and that ensures the safety of the elevator hoistway is moved into the use position. In this case e.g. service drive is possible in connection with servicing jobs after the serviceman who moved into the elevator hoistway to work has moved a mechanical safety device disposed in the working space into a use position. The elevator hoistway can contain two or more mechanical safety devices movable into a use position that ensure the safety of the elevator hoistway. According to the invention only the one or more mechanical safety devices disposed in a delimited safety clearance at any given time are moved into the use position in order to allow service drive, which facilitates the working process of a fitter and a serviceman. This type of safety clearance can be delimited, for instance, in the space above the elevator car in the elevator hoistway, in which case the serviceman can work e.g. from the roof of the elevator car. A safety clearance can be delimited also e.g. for the bottom end zone of the elevator hoistway, in the environment of the pit of the elevator hoistway, in which case a serviceman can work in the pit of the elevator hoistway and in the environment of the pit. The mechanical safety devices that ensure the safety of the area above the elevator car in the elevator hoistway are e.g. a buffer that is disposed on the roof of the elevator car and can be moved into a use position, and also a buffer that is disposed below the counterweight of the elevator and can be moved into a use position. The buffer disposed below the counterweight limits the movement of the counterweight in the bottom space of the elevator hoistway and simultaneously it limits the movement of the elevator car in the top space of the hoistway. On the other hand, the elevator system according to the invention can also be an elevator without counterweight, such as a hydraulic elevator, a linear motor elevator, or the type of rope elevator in which the counterweight is omitted by changing the roping of the elevator. The mechanical safety device that ensures the safety of the bottom end zone of the elevator hoistway can be e.g. a buffer that is disposed below the elevator car and that can be moved into a use position. A mechanical safety device can also be a mechanical detent to be fitted and activated on the elevator car, which in its use position is fitted to collide with a counterpart disposed in the elevator hoistway.

In one embodiment of the invention the safety arrangement comprises a service drive unit, which is fitted into the elevator hoistway. The safe area delimited in the elevator hoistway in this case also comprises the environment of the service drive unit. The service drive unit can be fitted onto the roof of the elevator car, in which case a drive with the elevator is possible when a serviceman has moved onto the roof of the elevator car, and when the mechanical safety device that ensures the safety of the area above the elevator car in the elevator hoistway is moved into the use position. In one embodiment of the invention the service drive unit is disposed in the pit of the elevator hoistway. In this case service drive is possible when a serviceman has moved into the pit of the elevator hoistway and when the mechanical safety device that ensures the safety in the elevator hoistway of the bottom end zone of the elevator hoistway is moved into the use position.

In one embodiment of the invention the detector of intrusion into the elevator hoistway comprises a memory, in which information about an intrusion into the elevator hoistway, as well as about the operating mode of the detector at any given time, is recorded. These types of data to be saved in the memory are e.g. information about drive prevention mode, and also information about whether an intrusion into the elevator hoistway occurred via the entrance of the pit of the elevator hoistway or via some other entrance of the elevator hoistway. The aforementioned memory of the detector of intrusion into the elevator hoistway is also in connection with the electricity supply of the detector of intrusion into the elevator hoistway such that in connection with an operational nonconformance of the primary electricity supply, only a switch from the mode that permits normal drive to a mode that prevents drive is possible; instead, a switch from a mode that prevents drive back to a mode that permits normal drive is possible only when supplying the operating electricity of the detector via the primary electricity supply.

The detector of intrusion into the elevator hoistway according to the invention can also be fitted in connection with an existing safety system of the elevator, e.g. in connection with modernization.

PRESENTATION OF DRAWINGS

Figure 2:
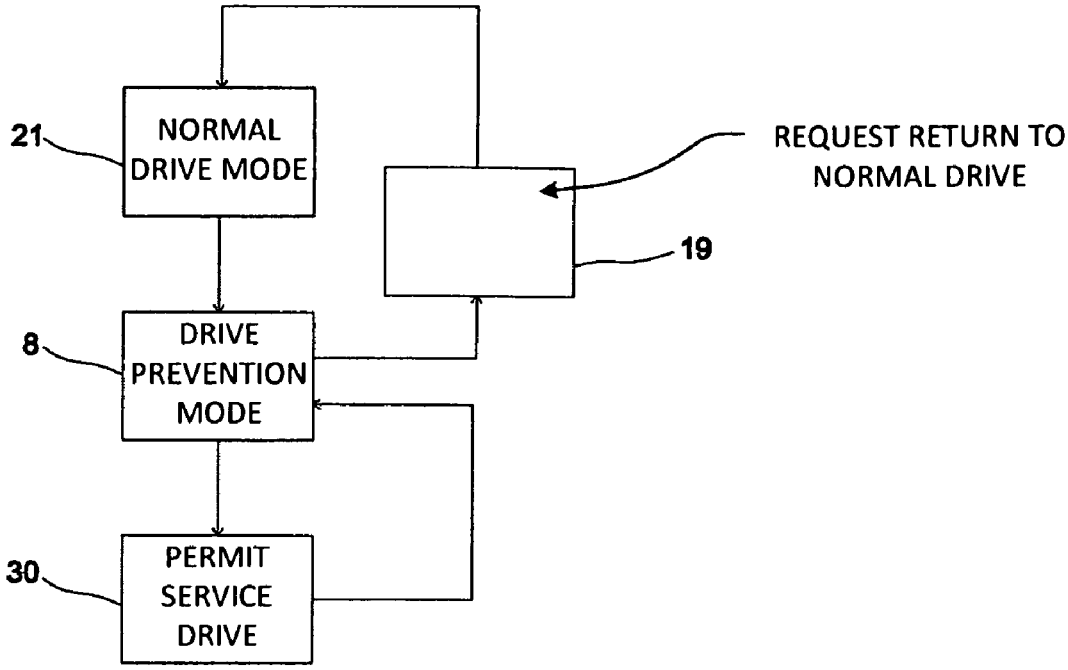
Figure 3:
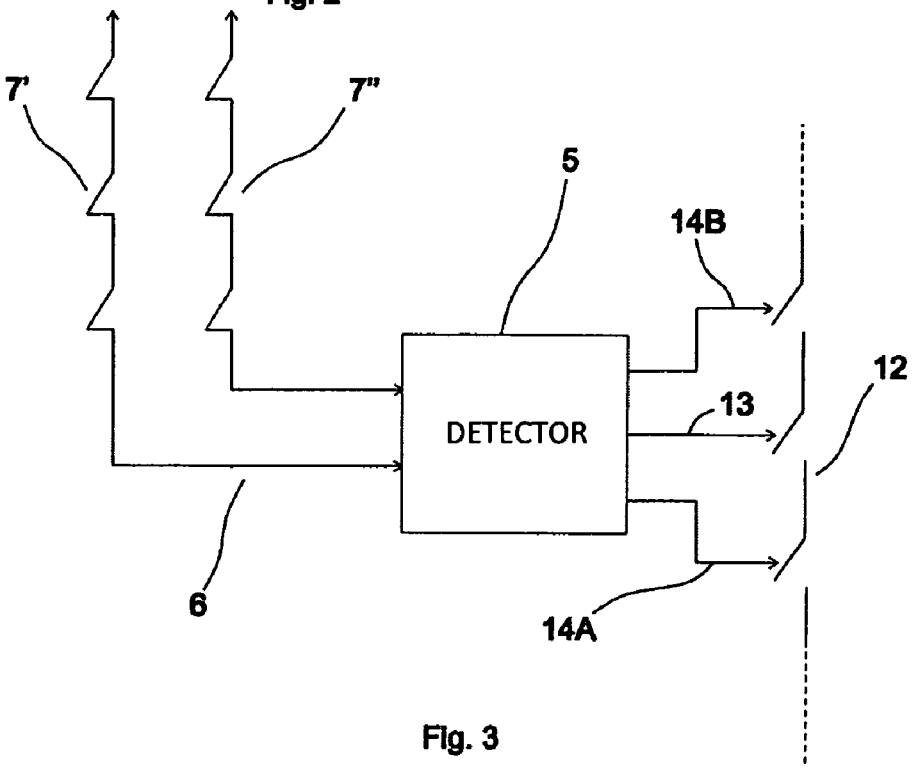
Figure 4:
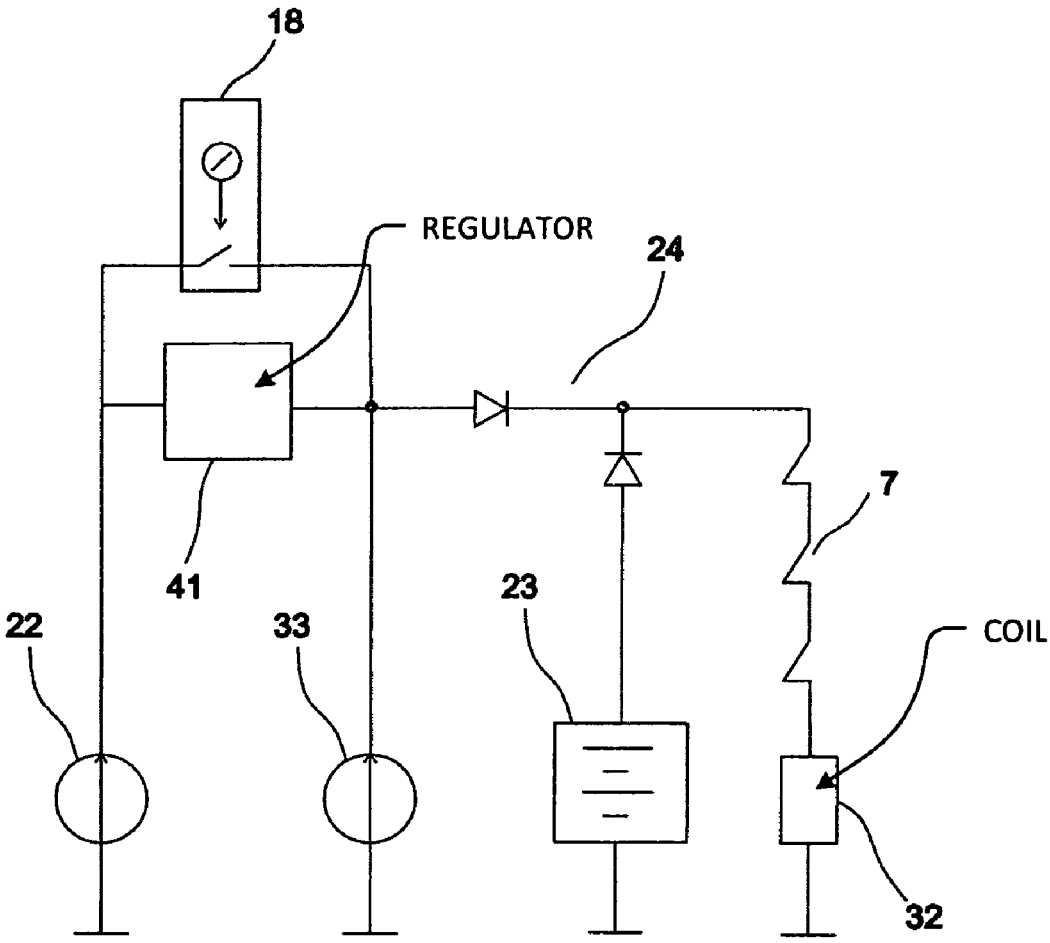
Figure 5:
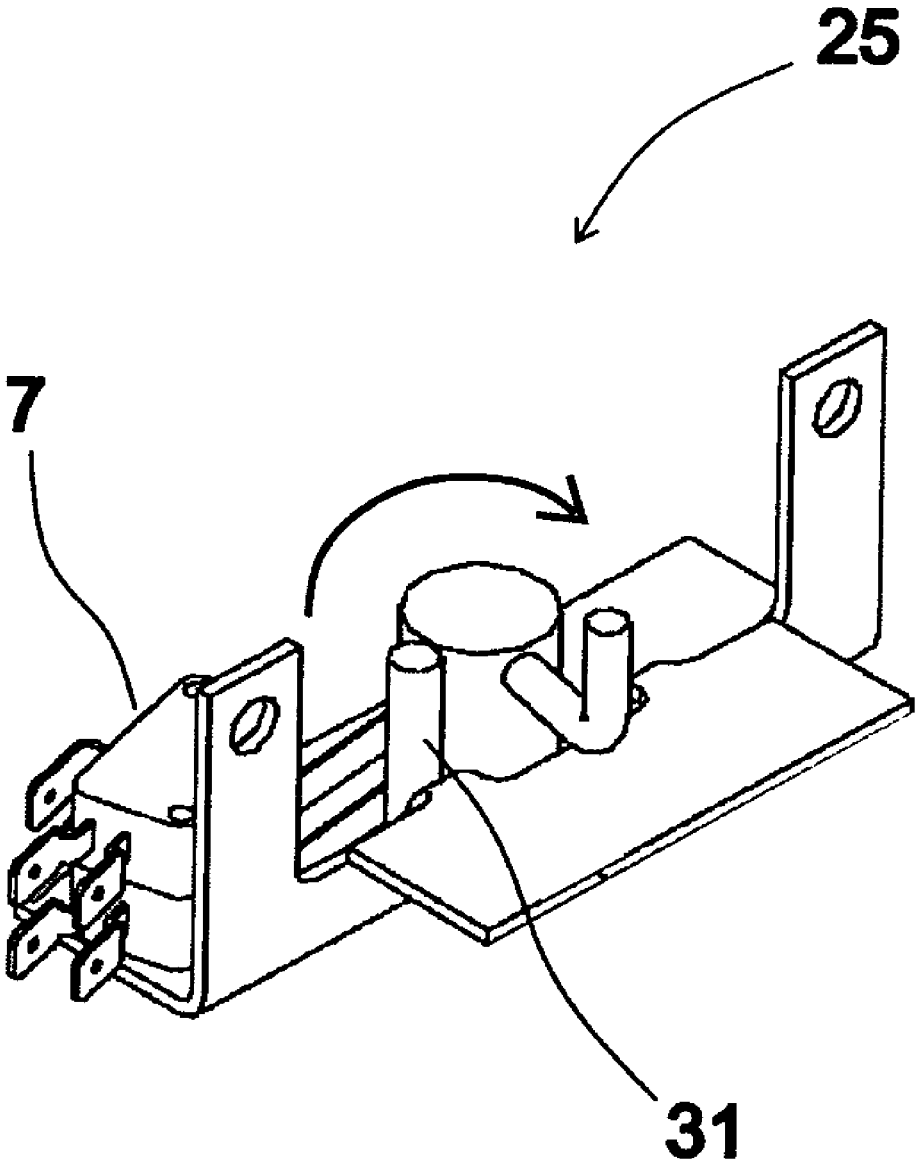

In the following, the invention will be described in more detail with reference to the attached drawings, wherein FIG. 1 presents a safety arrangement of an elevator according to the invention FIG. 2 presents the operation of the detector of intrusion into the elevator hoistway according to the invention as a flowchart FIG. 3 presents a detector of intrusion into the elevator hoistway according to the invention fitted in connection with the safety circuit of an elevator FIG. 4 presents the electricity supply of a detector of intrusion into the elevator hoistway according to the invention FIG. 5 presents a detail of an emergency opening apparatus of a door according to the invention

EMBODIMENTS

In the elevator system of FIG. 1, the elevator car 1 and the counterweight are supported with elevator ropes passing via the rotating traction sheave 32 of the elevator machine. The power supply from the electricity network 35 to the elevator machine occurs with a power supply circuit 34, which comprises a frequency converter.

In normal drive of the elevator people move into the elevator car 1 that is waiting in the elevator hoistway 2 at the point of the entrance via the entrance 9, 10 of the elevator hoistway. Intrusion into the elevator hoistway occurs when opening the door of the entrance 9, 10 of the elevator hoistway e.g. with the emergency opening apparatus in a situation in which the elevator car 1 is not situated at the point of the opened door in the elevator hoistway 2.

A detector 5 of intrusion into the elevator hoistway is fitted to the safety arrangement of the elevator system, which detector is an electrical safety device by means of which intrusion into the elevator hoistway, as well as the area from where the intrusion has occurred, is determined. The detector of intrusion into the elevator hoistway reacts to the determined intrusion by delimiting a safe area 27, 28 in the elevator hoistway on the basis of the area of intrusion 9, 10. The detector disconnects the safety circuit 12 of the elevator. When the safety circuit is disconnected, the power supply to the elevator machine as well as to the brake control 33 is also disconnected, in which case driving with the elevator is prevented. Further, the detector cross-connects the safety circuit switches that measure the position of the mechanical safety devices disposed outside the delimited safe area of the elevator hoistway, in which case service drive of the elevator is possible after the mechanical safety devices that are disposed in the safe area 27, 28 are moved into the use position.

Service drive occurs with a service drive unit 40, which is fitted on the roof of the elevator car. The service drive unit comprises a service drive switch 17, as well as control devices for moving the elevator car. The safe area 27, 28 of the elevator hoistway comprises the environment of the service drive unit, i.e. in this case the area of the roof of the elevator car.

In one alternative embodiment of the invention the service drive unit 40 is fitted into the pit of the elevator hoistway. The safe area 27, 28 of the elevator hoistway comprises in this case the environment of the area of the pit of the elevator hoistway.

Switches 7 are fitted in connection with the emergency opening apparatuses 25 of the landing doors 9, 10 of the elevator that are situated on different floors of the building. The switches are fitted on the path of movement of the turnable part 31 of the emergency opening apparatus in the direction of the arrow according to FIG. 5 such that the contact of the switch opens with an emergency key when using the emergency opening apparatus 25.

The switches fitted in connection with the emergency opening apparatuses 25 of the landing doors 9 of other than the lowermost floor are connected to each other in series, and the serial circuit is taken to the detector 5 of intrusion into the elevator hoistway. The detector 5 measures the status of the serial circuit of the switches, and when it detects that the serial circuit is broken the detector 5 deduces that a serviceman has intruded into the elevator hoistway onto the roof of the elevator car. In this case the detector 5 delimits the safe area of the elevator hoistway to the environment 28 of the area of the roof of the elevator hoistway by cross-connecting the safety circuit switch that measures the position of the turnable buffer disposed below the elevator car. Owing to the cross-connection, service drive is permitted after the serviceman who moved to the roof of the elevator hoistway has turned the aforementioned buffer 3 disposed on the roof into the vertical position.

In an alternative embodiment of the invention a buffer 4 is disposed under the counterweight instead of under the roof of the elevator hoistway. If a service drive is in this case driven from the service drive unit disposed on the roof of the elevator car, both the turnable buffer 4 disposed under the counterweight and also the turnable buffer 11 disposed under the elevator car must first be turned to the vertical position.

The switches fitted in connection with the emergency opening apparatus of the landing door/landing doors 9 of the lowermost floor are also connected to each other in series, and the serial circuit is taken to the detector 5 of intrusion into the elevator hoistway. The detector 5 measures the status of the serial circuit of switches, and when it detects that the serial circuit is broken the detector 5 deduces that a serviceman has intruded into the pit of the elevator hoistway. If the service drive unit 40 in this case is disposed on the roof of the elevator car, the detector 5 delimits the safe area of the elevator hoistway to the environment 27 of the bottom end zone of the elevator hoistway as well as also to the environment 28 of the area of the roof of the elevator car.

In one alternative embodiment of the invention the service drive unit 40 is fitted in the pit 40 of the elevator hoistway. In this case, after determining an intrusion into the pit of the elevator hoistway the detector 5 of intrusion into the elevator hoistway delimits the safe area of the elevator hoistway to the environment 28 of the bottom end zone of the elevator hoistway by cross-connecting the safety circuit switch that measures the position of the turnable buffer 11 disposed on the roof of the elevator car. Owing to the cross-connection, service drive is permitted after the serviceman who moved into the pit of the elevator hoistway has turned the buffer 11 disposed below the elevator car into the vertical position.

In one alternative embodiment of the invention the pit of the elevator hoistway does not contain turnable buffers. In this case service drive is permitted only manually from the service drive unit 40 disposed on the roof of the elevator car; driving with the elevator is in this case prevented when the detector 5 determines an intrusion into the pit of the elevator hoistway. In one embodiment of the invention driving with the elevator is prevented using also an overspeed governor in addition to a machinery brake that brakes the movement of the elevator machine. Movement of a rotating part of the overspeed governor is prevented with a solenoid, which engages mechanically to brake the movement of the rotating part of the overspeed governor. If the elevator car in this case starts to move towards the pit of the elevator hoistway, the overspeed governor activates the safety gear, which engages mechanically between the elevator car and the guide rail to brake the movement of the elevator car.

Service drive occurs by means of the service drive unit 40, such that the service drive switch 17 disposed in the service drive unit is turned into the service drive position, after which the elevator car is moved with the control devices disposed in the service drive unit. After service drive has ended, the service drive switch 17 is turned back to the normal position.

The safety arrangement also comprises a manually-controlled return apparatus 18 of normal drive of the elevator, which is fitted outside the elevator hoistway, e.g. in connection with the landing door of the lowermost floor. The return apparatus 18 is connected to the detector 5 of intrusion into the elevator hoistway. The return apparatus 18 is key-operated, in which case when the key of the return apparatus 18 is turned, the return apparatus 18 forms a request for return to normal drive, which is transferred and processed in the detector 5 of intrusion into the elevator hoistway. In this case, permitting normal drive requires that the doors of the entrances of the elevator hoistway are closed, and that the mechanical safety devices of the elevator hoistway are moved from the use position into the position that permits normal drive of the elevator. Permitting normal drive also requires that the electricity supply of the detector 5 of intrusion into the elevator hoistway occurs normally from the electricity network. During an electricity outage the detector 5 receives its operating electricity from an accumulator 23. Owing to the accumulator backup, a possible intrusion into the elevator hoistway can also be detected during an electricity outage. The electricity supply of the detector of intrusion into the elevator hoistway is presented in more detail in FIG. 4 The detector 5 comprises an interface to a primary electricity supply 22, which is a DC voltage transformed from the voltage of the electricity network, the magnitude of which is approx. 24 V. The aforementioned 24 V primary supply voltage 22 is transformed with a regulator 41 into DC voltage 33, the magnitude of which is approx. 13-14 V. The detector also comprises an interface to a backup system 23 of the electricity supply, which comprises' an accumulator. The selection of the supply voltage between the regulated DC voltage 33 and the accumulator voltage 23 is made with diodes 24 such that the diodes select the largest of the available voltages. In this case in connection with an electricity outage a 12 V accumulator connects to supply electricity to the detector of intrusion into the elevator hoistway. During normal operation of the electricity network the diode that is in series with the accumulator connects automatically into prevention state, disconnecting the electricity supply from the accumulator to the detector of intrusion into the elevator hoistway. In the example of FIG. 4 the control logic of the detector of intrusion into the elevator hoistway is made with relays such that the coil 32 of the relay requires a 24 V operating voltage to energize, but the coil 32 stays energized also with 12 V accumulator voltage. The electricity supply to the coil 32 of the relay is taken via the switches 7 that monitor the status of the landing doors. Normally the electricity supply to the coil 32 occurs from a regulated 13-14 V DC voltage; during an electricity outage the electricity supply occurs from a 12 V accumulator voltage. The switch of the return apparatus 18 of normal drive is connected in parallel with the regulator 41, in which case with the control of the return apparatus a 24 V voltage can be supplied to the coil 32 of the relay. The mode switch from the mode that permits normal drive to the mode that prevents normal drive occurs when the relay 32 is de-energized. This occurs if one of the landing doors opens, in which case the contact of the switch 7 that monitors the status of the landing door disconnects and the electricity supply to the coil 32 of the relay ceases. The mode switch to the mode that permits normal drive, on the other hand, requires that the relay 32 is energized. Energizing of the relay occurs when a 24 V voltage is supplied to the coil 32 of the relay. Energizing of the relay requires that the contacts of all the switches that monitor the status of the landing doors are closed and that a 24 V voltage is connected to the coil of the relay with the control of the return apparatus 18 of normal drive.

FIG. 2 presents the control logic of a detector of intrusion into the elevator hoistway by means of a flow chart. After determining intrusion into the elevator hoistway, the detector switches from the mode 21 that permits normal drive to the drive prevention mode 8. In this case the detector determines the area from where intrusion into the elevator hoistway occurred, and delimits the safe area in the elevator hoistway on the basis of the area of intrusion. The detector of intrusion into the elevator hoistway switches to a status 30 that permits service drive after the mechanical safety device that is disposed in the delimited safe area in the elevator hoistway is moved into the use position.

Service drive also first requires the turning of the service drive switch into the service drive position.

Returning to normal drive first requires the cancellation of the aforementioned functions. In this case the service drive switch is turned back to the normal position; the mechanical safety device disposed in the delimited safe area in the elevator hoistway is moved out of the use position back to the position that permits normal drive; and after this a request for a return to normal drive 19 is formed with the manual return apparatus of normal drive.

FIG. 3 presents a safety arrangement according to the invention, in which the detector 5 of intrusion into the elevator hoistway is fitted in connection with the safety circuit of the elevator. The safety arrangement comprises a switch 7 in connection with the emergency opening apparatus of the door of each entrance of the elevator hoistway, the contact of which switch opens when using the emergency opening apparatus with an emergency key.

The aforementioned switches 7 fitted in connection with the doors of the different entrances are connected to each other in series such that the switches 7' of the doors of the entrances of the pit of the elevator hoistway form a first serial circuit, and the switches 7" of the doors of other entrances than that of the pit of the elevator hoistway form a second serial circuit. The detector 5 of intrusion into the elevator hoistway reads the voltage information supplied to the input of the serial circuit from the output of the serial circuit 7', 7" of the switches, and when the voltage is disconnected deduces an intrusion into the elevator hoistway. In this case the detector 5 generates a prevention of drive by disconnecting the signal 13, in which case the safety circuit opens and driving with the elevator is prevented.

After it detects an intrusion into the elevator hoistway via an entrance other than that of the pit of the elevator hoistway, the detector 5 controls the poles of the safety circuit switch that measures the position of the mechanical safety device disposed in the elevator hoistway below the elevator car with a signal to short-circuit 14A. The detector 5 also disconnects the poles of the safety circuit switch that measures the position of the mechanical safety device fitted to the roof of the elevator car with a short-circuit signal 14B. In this case the safety circuit 12 of the elevator switches to an operating mode in which service drive is permitted after the mechanical safety device fitted to the roof of the elevator car is moved into the use position.

The invention is described above by the aid of a few examples of its embodiment. It is obvious to the person skilled in the art that the invention is not limited to the embodiments described above, but that many other applications are possible within the scope of the inventive concept defined by the claims presented below.

It is also obvious to the skilled person that the detector of intrusion into the elevator hoistway can be implemented in many different ways, taking into account the known design criteria set for electrical and/or electronic safety devices. In this case the detector can be designed to be redundant by duplicating the control logic; likewise, measurement of the status of the entrances to the elevator hoistway can be duplicated by fitting two sensors that determine the status of an entrance in connection with the entrance. The detector of intrusion into the elevator hoistway can also be fully or partially integrated into some other control device of the elevator system.

The invention claimed is:

1. A safety arrangement of an elevator, which comprises a mechanical safety device that ensures the safety of the elevator hoistway and can be moved into a use position, and which safety arrangement of an elevator comprises a detector of intrusion into the elevator hoistway, which detector is fitted to receive measuring data from the sensors that measure the status of the entrances of the elevator hoistway, and also to determine intrusion into the elevator hoistway from the measuring data received, and after determining an intrusion to switch the safety arrangement of the elevator into an operating mode in which driving with the elevator is prevented, wherein the aforementioned detector of intrusion into the elevator hoistway is fitted to determine on the basis of the measuring data received the area of intrusion from where intrusion into the elevator hoistway has occurred, and in that the detector of intrusion into the elevator hoistway is fitted to delimit a safe area of the elevator hoistway corresponding to the determined area of intrusion, and in that the safety arrangement of the elevator is fitted to permit service drive after the mechanical safety device that is disposed in the safe area delimited by the detector of intrusion into the elevator hoistway and that ensures the safety of the elevator hoistway is moved into the use position.

2. The safety arrangement according to claim 1, wherein the safety arrangement of the elevator comprises two or more mechanical safety devices that ensure the safety of the elevator hoistway and are movable into a use position, and in that the safety arrangement of the elevator is fitted to permit service drive after the one or more mechanical safety devices that are disposed in the safe area delimited by the detector of intrusion into the elevator hoistway and that ensure the safety of the elevator hoistway are moved into the use position.

3. The safety arrangement according to claim 1, wherein the safety arrangement comprises a service drive unit, which is fitted into the elevator hoistway, and which service drive unit comprises a service drive switch, as well as control devices for moving the elevator car, and in that the aforementioned delimited safe area of the elevator hoistway comprises the environment of the service drive unit.

4. The safety arrangement according to claim 1, wherein at least one mechanical safety device that ensures the safety of the elevator hoistway and that can be moved into the use position is fitted in the proximity of the service drive unit.

5. The safety arrangement according to claim 1, wherein the safety arrangement comprises a mechanical safety device that ensures the safety of the area above the elevator car in the elevator hoistway and that can be moved into the use position, and in that if intrusion into the elevator hoistway has occurred via some other entrance of the elevator hoistway than via the entrance of the pit of the elevator hoistway, the safety arrangement of the elevator is fitted to permit service drive after the aforementioned mechanical safety device that ensures the safety in the elevator hoistway of the area above the elevator car is moved into the use position.

6. The safety arrangement according to claim 5, wherein the aforementioned mechanical safety device that ensures the safety in the elevator hoistway of the area above the elevator car and that can be moved into the use position is fitted in the elevator hoistway to the roof of the elevator car and/or to the bottom of the counterweight.

7. The safety arrangement according to claim 1, wherein the safety arrangement comprises a mechanical safety device that ensures the safety of the bottom end zone of the elevator hoistway and that can be moved into a use position, and in that if it is determined that intrusion into the elevator hoistway has occurred via the entrance of the pit of the elevator hoistway, the safety arrangement of the elevator is fitted to permit service drive after the aforementioned mechanical safety device that ensures the safety in the elevator hoistway of the bottom end zone of the elevator hoistway is moved into the use position.

8. The safety arrangement according to claim 7, wherein the arrangement comprises a service drive unit, which is fitted on the roof of the elevator car, and in that if it is determined that intrusion into the elevator hoistway has occurred via the entrance of the pit of the elevator hoistway, the safety arrangement of the elevator is fitted to permit service drive after both the aforementioned mechanical safety device that ensures the safety in the elevator hoistway of the bottom end zone of the elevator hoistway as well as also the aforementioned mechanical safety device that ensures the safety in the elevator hoistway of the area above the elevator car are moved into the use position.

9. The safety arrangement according to claim 7, wherein the aforementioned mechanical safety device that ensures the safety of the bottom end zone of the elevator hoistway and that can be moved into the use position is fitted below the elevator car in the elevator hoistway.

10. The safety arrangement according to claim 1, wherein the detector of intrusion into the elevator hoistway is fitted in connection with the safety circuit of the elevator, and in that the detector is fitted to receive measuring data from the sensors that measure the locking of the entrances of the elevator hoistway, and in that the detector is fitted to form a prevention of drive if an intrusion into the elevator hoistway is determined from the measuring data received from the sensors that measure the locking of the entrances of the elevator hoistway, and in that the detector of intrusion into the elevator hoistway is fitted to form an activation signal of service drive using the determined intrusion area data, in which case after detecting an intrusion into the elevator hoistway via some other entrance of the elevator hoistway than via the entrance of the pit of the elevator hoistway, the detector is fitted to generate an activation signal of service drive, in response to which the safety circuit of the elevator is switched to a mode in which service drive is permitted after the safety switch fitted in connection with the mechanical safety device that ensures the safety of the aforementioned area above the elevator car in the elevator hoistway indicates that the safety device that ensures the safety in the elevator hoistway of the area above the elevator car is moved into the use position, and in which case after detecting an intrusion into the elevator hoistway via the entrance of the pit of the elevator hoistway, the detector is fitted to generate an activation signal of service drive to the safety circuit of the elevator, in response to which the safety circuit of the elevator is switched to a mode in which service drive is permitted after the safety switch fitted in connection with the mechanical safety device that ensures the safety of the aforementioned bottom end zone of the elevator hoistway indicates that the mechanical safety device that ensures the safety of the bottom end zone of the elevator hoistway is moved into the use position.

11. The safety arrangement according to claim 1, wherein if intrusion into the elevator hoistway has occurred via some other entrance of the elevator hoistway than via the entrance of the pit of the elevator hoistway, the safety arrangement of the elevator is fitted to permit service drive after the mechanical safety device fitted in the elevator hoistway under the counterweight as well as also the mechanical safety device fitted in the elevator hoistway under the elevator car are moved into the use position.

12. The safety arrangement according to claim 1, wherein service drive is permitted after the aforementioned mechanical safety device that ensures the safety of the elevator hoistway is moved into the use position, and when the service drive switch is moved into the service drive position.

13. The safety arrangement according to claim 1, wherein the safety arrangement comprises a manually controllable return apparatus of normal drive of the elevator, the request for a return to normal drive formed with which is taken to the detector of intrusion into the elevator hoistway, and in that the detector of intrusion into the elevator hoistway is fitted to switch the safety arrangement of the elevator into a mode that permits normal drive as a response to the aforementioned request for a return to normal drive, to the position data of the entrances of the elevator hoistway, and also to the position data of the mechanical safety devices of the elevator hoistway.

14. The safety arrangement according to claim 13, wherein the detector of intrusion into the elevator hoistway comprises an interface to a primary electricity supply, and also an interface to a backup system of the electricity supply, and in that the detector of intrusion into the elevator hoistway comprises a selection circuit of electricity supply for connecting the aforementioned electricity supply of the backup system to supply electricity to the detector of intrusion into the elevator hoistway in connection with an operational nonconformance of the primary electricity supply, and in that the detector of intrusion into the elevator hoistway is arranged during an operational nonconformance of the primary electricity supply into an operating mode in which a request for a return to normal drive formed with the return apparatus of normal drive is left unregistered.

15. The safety arrangement according to claim 1, wherein the safety arrangement comprises, in connection with each entrance of the elevator hoistway, a switch fitted in connection with the emergency opening apparatus of at least one door of an entrance on the path of movement of the turnable part of the emergency opening apparatus, the contact of which switch is fitted to open with an emergency key when using the emergency opening apparatus;

and in that the aforementioned switches fitted in connection with the doors of the different entrances are connected to each other in series such that the switches of the doors of the entrances of the pit of the elevator hoistway form a first serial circuit;

and in that the switches of the doors of other entrances than that of the pit of the elevator hoistway form a second serial circuit;

and in that the detector of intrusion into the elevator hoistway is fitted to read the electrical magnitude supplied to the input of the serial circuit from the output of the aforementioned serial circuit of the switches, and to deduce intrusion into the elevator hoistway on the basis of the electrical magnitude read, in which case intrusion into the pit of the elevator hoistway is deduced on the basis of the electrical magnitude read from the first serial circuit;

and in which case intrusion onto the roof of the elevator car is deduced on the basis of the electrical magnitude read from the second serial circuit;

and in that the detector of intrusion into the elevator hoistway comprises a memory, in which the intrusion into the elevator hoistway deduced on the basis of the aforementioned read electrical magnitude is recorded.

16. A method for monitoring safety in an elevator system, the method comprising:

fitting a mechanical safety device that ensures the safety of the elevator hoistway and that can be moved into a use position into the elevator hoistway;

measuring the status of the entrances of the elevator hoistway;

determining intrusion into the elevator hoistway from the measured the status of the entrances of the elevator hoistway;

preventing driving with the elevator if intrusion into the elevator hoistway is determined;

determining an area of intrusion, from where intrusion into the elevator hoistway has occurred, from the measured status of the entrances of the elevator hoistway;

delimiting the safe area of the elevator hoistway corresponding to the determined area of intrusion; and permitting service drive after the mechanical safety device that is disposed in the delimited safe area and that ensures the safety of the elevator hoistway is moved into the use position.

17. The method according to claim 16, wherein:

two or more mechanical safety devices that ensure the safety of the elevator hoistway and that can be moved into the use position are fitted into the elevator hoistway; and service drive is permitted after the one or more mechanical safety devices that are disposed in the delimited safe area and that ensure the safety of the elevator hoistway are moved into the use position.

18. The method according to claim 16, further comprising:

fitting a service drive unit into the elevator hoistway; and setting the aforementioned delimited safe area of the elevator hoistway to include the environment of the service drive unit.

* * * * *